US009124973B2

(12) United States Patent
Wu

(10) Patent No.: US 9,124,973 B2
(45) Date of Patent: Sep. 1, 2015

(54) EARPHONE JACK CIRCUIT AND PORTABLE ELECTRONIC DEVICE USING THE SAME

(71) Applicants: SHENZHEN FUTAIHONG PRECISION INDUSTRY CO., LTD., Shenzhen (CN); Chi Mei Communication Systems, Inc., New Taipei (TW)

(72) Inventor: Hai-Zhou Wu, Shenzhen (CN)

(73) Assignees: SHENZHEN FUTAIHONG PRECISION INDUSTRY CO., LTD., Shenzhen (CN); Chi Mei Communication Systems, Inc., New Taipei (TW)

( * ) Notice: Subject to any disclaimer, the term of this patent is extended or adjusted under 35 U.S.C. 154(b) by 330 days.

(21) Appl. No.: 13/710,488

(22) Filed: Dec. 11, 2012

(65) Prior Publication Data

US 2013/0287221 A1 Oct. 31, 2013

(30) Foreign Application Priority Data

Apr. 26, 2012 (CN) ..... 2012 1 0125648

(51) Int. Cl.
*H04R 1/10* (2006.01)

(52) U.S. Cl.
CPC ..... *H04R 1/1041* (2013.01); *H04R 1/1091* (2013.01); *H04R 2420/07* (2013.01)

(58) Field of Classification Search
None
See application file for complete search history.

*Primary Examiner* — Brenda Bernardi
(74) *Attorney, Agent, or Firm* — Novak Druce Connolly Bove + Quigg LLP

(57) ABSTRACT

An earphone jack circuit includes an earphone jack configured to receive an earphone plug, a frequency modulation (FM) signal processing circuit electrically connected to the earphone jack, and an amplifying circuit. The FM signal processing circuit includes a first matching circuit electrically connected to the earphone jack, and an amplifying circuit electrically connected to the first matching circuit. The first matching circuit receives an initial FM signal from the earphone jack and executes a first filtering process for the initial FM signal when the earphone plug is inserted into the earphone jack. The amplifying circuit amplifies the filtered FM signal.

10 Claims, 1 Drawing Sheet

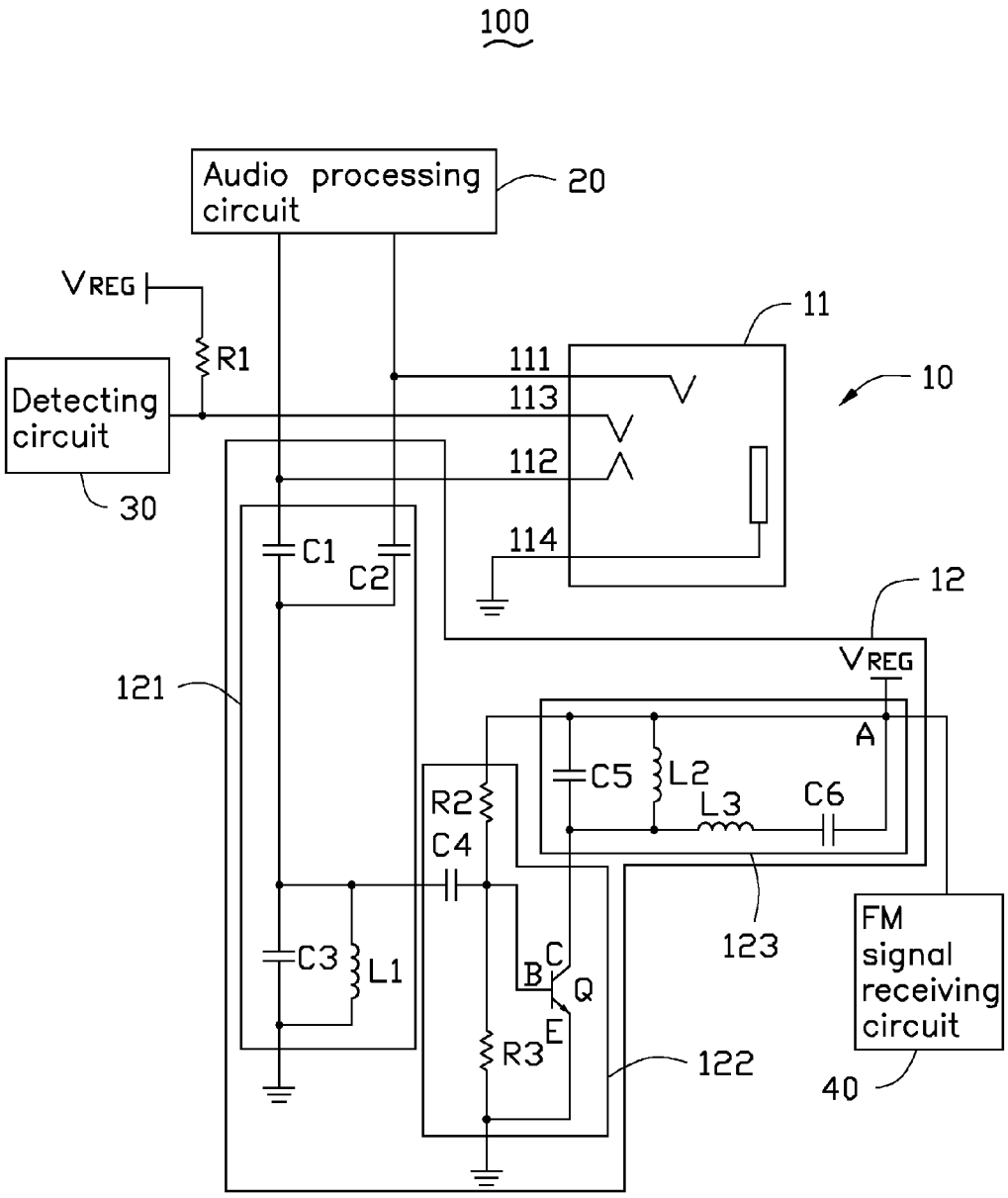
100
Audio processing circuit
20
VREG
R1
Detecting circuit
30
11
10
111
113
112
114
C1
C2
12
VREG
121
A
C5
L2
L3
C6
R2
C4
123
C3
L1
C
B
Q
E
R3
122
FM signal receiving circuit
40

EARPHONE JACK CIRCUIT AND PORTABLE ELECTRONIC DEVICE USING THE SAME

BACKGROUND

1. Technical Field

The disclosure generally relates to earphone jack circuits, and particularly to an earphone jack circuit for a portable electronic device having a frequency modulation (FM) function.

2. Description of Related Art

A portable electronic device such as a mobile phone commonly comprises a FM function. When a built-in FM antenna is installed in the mobile phone, the built-in FM antenna may be susceptible to interference from other electronic components inside the mobile phone because a volume of the mobile phone is limited and which may lead to negative influences on a FM performance of the mobile phone. Thus, an external FM antenna is usually used in the mobile phone to realize the FM function.

To simplify an external structure of the mobile phone, an earphone of the mobile phone is used to severe as the external FM antenna to receive FM signals. However, most earphones severed as the FM antenna have relative lower sensitivities while receiving FM signals than the special external FM antennas and the mobile phone may be difficult to obtain a desired FM performance.

Therefore, there is room for improvement within the art.

BRIEF DESCRIPTION OF THE DRAWING

Many aspects of the present disclosure can be better understood with reference to the following drawing. The components in the drawing are not necessarily drawn to scale, the emphasis instead being placed upon clearly illustrating the principles of the disclosure.

The figure is a partial circuit diagram of a portable electronic device including an earphone jack circuit, according to an exemplary embodiment of the disclosure.

DETAILED DESCRIPTION

The figure is a partial circuit diagram of a portable electronic device 100, according to an exemplary embodiment of the disclosure. The portable electronic device 100 includes an earphone jack circuit 10, an audio processing circuit 20, a detecting circuit 30, and a FM signal receiving circuit 40.

The earphone jack circuit 10 includes an earphone jack 11 and a FM signal processing circuit 12. The earphone jack 11 is configured to receive an earphone plug and connect to an earphone. The earphone jack 11 includes a right channel contact 111, a left channel contact 112, a detecting contact 113, and a ground contact 114.

The right channel contact 111 and the left channel contact 112 are electrically connected to the audio processing circuit 20. The portable electronic device 100 comprises a normal working mode and an FM mode. When the portable electronic device 100 is in the normal working mode, the right channel contact 111 and the left channel contact 112 transmit an audio signal between the audio processing circuit 20 and the earphone. When the portable electronic device 100 is in the FM mode, the right channel contact 111 and the left channel contact 112 receives an initial FM signal with the earphone, and transmits the initial FM signal to the FM signal processing circuit 12.

The detecting contact 113 is electrically connected to a power supply VREG by a resistor R1, and also electrically connected to the detecting circuit 30. In one exemplary embodiment, when the detecting contact 113 detects the earphone plug is inserted, the detecting contact 113 is in a high level (logic 1). When the detecting contact 113 detects no earphone plug is inserted, the detecting contact 113 is in a low level (logic 0). Thus, the detecting circuit 30 obtains whether the earphone plug is inserted into the earphone jack 11 according to the detecting contact 113. When no earphone plug is inserted into the earphone jack 11, the detecting circuit 30 controls the audio processing circuit 12 and related FM processes to stop working. The ground contact 114 is grounded.

The FM signal processing circuit 12 includes a first matching circuit 121, an amplifying circuit 122 and a second matching circuit 123 connected in series. The first matching circuit 121 is electrically connected to the right channel contact 111 and the left channel contact 112 and receives the initial FM signal. The first matching circuit 121 executes a first filtering process for the initial FM signal to reduce noise of the initial FM signal, and also match the FM signal with the earphone to raise a FM performance of the portable electronic device 100. The amplifying circuit 122 amplifies the filtered FM signal and transmits the amplified FM signal to the second matching circuit 123. The second matching circuit 123 executes a second filtering process for the amplified FM signal to raise a sensitivity of the earphone.

In one exemplary embodiment, the first matching circuit 121 includes a first capacitor C1, a second capacitor C2, a third capacitor C3, and an inductor L1. A first end of the first capacitor C1 is electrically connected to a first end of the second capacitor C2. A second end of the first capacitor C1 is electrically connected to the audio processing circuit 20 and the left channel contact 112. A second end of the second capacitor C2 is electrically connected to the audio processing circuit 20 and the right channel contact 111. The third capacitor C3 and the inductor L1 are electrically connected in parallel between the second ends of the first and second capacitors C1, C2 and ground.

The amplifying circuit 122 includes a transistor Q, a first bias resistor R2, a second bias resistor R3, and a fourth capacitor C4. A base B of the transistor Q is electrically connected to the second ends of the first and second capacitors C1, C2 by the fourth capacitor C4. A first end of the first bias resistor R2 is electrically connected to the base B. A second end of the first bias resistor R2 is electrically connected to a power supply VREG and forms an output terminal A connecting to the FM signal receiving circuit 40. A first end of the second bias resistor R3 is electrically connected to the base B and connected to the first bias resistor R2 in series. A second end of the second bias resistor R3 is electrically connected to an emitter E of the transistor Q and also grounded.

The second matching circuit 122 includes a fifth capacitor C5, a second inductor L2, a sixth capacitor C6, and a third inductor L3. The fifth capacitor C5 and the second inductor L2 are electrically connected in parallel between the output terminal A and a collector C of the transistor Q. The sixth capacitor C6 and the third inductor L3 are electrically connected in series between the output terminal A and the collector C.

The FM signal processing circuit 12 executes a first filtering process for the initial FM signal received from the earphone, amplifies the filtered FM signal, further executes a second filtering process for the amplified FM signal, and finally transmits the further filtered FM signal to the FM signal receiving circuit 40. The portable electronic device 100 can obtain a better FM performance than a device directly transmitting the initial FM signal to the FM signal receiving circuit 40.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An earphone jack circuit, comprising:

an earphone jack configured to receive an earphone plug, the earphone jack comprising a right channel contact and a left channel contact;

a frequency modulation (FM) signal processing circuit electrically connected to the earphone jack, the FM signal processing circuit comprising:

a first matching circuit electrically connected to the right channel contact and the left channel contact of the earphone jack, the first matching circuit receiving an initial FM signal from the earphone jack by the right channel contact and the left channel contact and executing a first filtering process for the initial FM signal when the earphone plug is inserted into the earphone jack; and an amplifying circuit electrically connected to the first matching circuit, the amplifying circuit amplifying the filtered FM signal.

2. The earphone jack circuit of claim 1, wherein the first matching circuit comprises a first capacitor, a second capacitor, a third capacitor and an inductor; a first end of the first capacitor is electrically connected to a first end of the second capacitor, the second end of the first capacitor is electrically connected to the left channel contact, the second end of the second capacitor is electrically connected to the right channel contact, the third capacitor and the inductor are electrically connected in parallel between the second ends of the first and second capacitors and ground.

3. The earphone jack circuit of claim 2, wherein the amplifying circuit comprises a transistor, a first bias resistor, a second bias resistor and a fourth capacitor; a base of the transistor is electrically connected to the second ends of the first and second capacitors by the fourth capacitor; a first end of the first bias resistor is electrically connected to the base, and a second end of the first bias resistor is electrically connected to a power supply and also forms an output terminal to output the amplified FM signal; a first end of the second bias resistor is electrically connected to the base and connected to the first bias resistor in series, and a second end of the second bias resistor is electrically connected to an emitter of the transistor and also grounded.

4. The earphone jack circuit of claim 3, wherein the signal processing circuit further comprises a second matching circuit, the second matching circuit is electrically connected between an emitter and the output terminal, the second matching circuit executes a second filtering process for the amplified FM signal.

5. The earphone jack circuit of claim 3, wherein the second matching circuit comprises a fifth capacitor, a second inductor, a sixth capacitor and a third inductor; the fifth capacitor and the second inductor are electrically connected in parallel between the output terminal and a collector of the transistor; the sixth capacitor and the third inductor are electrically connected in series between the output terminal and the collector.

6. A portable electronic device, comprising:

an earphone jack circuit comprising:

an earphone jack configured to receive an earphone plug, the earphone jack comprising a right channel contact and a left channel contact;

a frequency modulation (FM) signal processing circuit electrically connected to the earphone jack, the FM signal processing circuit comprising:

a first matching circuit electrically connected to the right channel contact and the left channel contact of the earphone jack, the first matching circuit receiving an initial FM signal from the earphone jack by the right channel contact and the left channel contact and executing a first filtering process for the initial FM signal when the earphone plug is inserted into the earphone jack; and an amplifying circuit electrically connected to the first matching circuit, the amplifying circuit amplifying the filtered FM signal;

an audio processing circuit electrically connected to the earphone jack circuit, when the portable electronic device being in a normally working mode, the earphone jack circuit transmitting audio signals between the audio processing circuit and the earphone plug; and a FM signal receiving circuit electrically connected to the amplifying circuit and receiving the amplified FM signal.

7. The portable electronic device of claim 6, wherein the first matching circuit comprises a first capacitor, a second capacitor, a third capacitor and an inductor; a first end of the first capacitor is electrically connected to a first end of the second capacitor, the second end of the first capacitor is electrically connected to the left channel contact, the second end of the second capacitor is electrically connected to the right channel contact, the third capacitor and the inductor are electrically connected in parallel between the second ends of the first and second capacitors and ground.

8. The portable electronic device of claim 7 wherein the amplifying circuit comprises a transistor, a first bias resistor, a second bias resistor and a fourth capacitor; a base of the transistor is electrically connected to the second ends of the first and second capacitors by the fourth capacitor; a first end of the first bias resistor is electrically connected to the base, and a second end of the first bias resistor is electrically connected to a power supply and also forms an output terminal to output the amplified FM signal; a first end of the second bias resistor is electrically connected to the base and connected to the first bias resistor in series, and a second end of the second bias resistor is electrically connected to an emitter of the transistor and also grounded.

9. The portable electronic device of claim 8, wherein the signal processing circuit further comprises a second matching circuit, the second matching circuit is electrically connected between an emitter and the output terminal.

10. The portable electronic device of claim 9, wherein the second matching circuit comprises a fifth capacitor, a second inductor, a sixth capacitor and a third inductor; the fifth capacitor and the second inductor are electrically connected in parallel between the output terminal and a collector of the transistor; the sixth capacitor and the third inductor are electrically connected in series between the output terminal and the collector.

* * * * *